US006129233A

United States Patent [19]

Schiller

[11] Patent Number: 6,129,233

[45] Date of Patent: Oct. 10, 2000

[54] REFUSE CONTAINER, MULTICHAMBER REFUSE CONTAINER IN PARTICULAR

[76] Inventor: Rolf Schiller, Linzgaustrasse 31, 88212 Ravensburg, Germany

[21] Appl. No.: 09/242,404

[22] PCT Filed: Aug. 14, 1997

[86] PCT No.: PCT/DE97/01792

§ 371 Date: Feb. 16, 1999

§ 102(e) Date: Feb. 16, 1999

[87] PCT Pub. No.: WO98/07640

PCT Pub. Date: Feb. 26, 1998

[30] Foreign Application Priority Data

Aug. 16, 1996 [DE] Germany ..... 196 32 996

[51] Int. Cl.[7] ..... B65D 1/24

[52] U.S. Cl. ..... 220/524; 220/526; 220/212.5; 220/826; 220/833; 220/843; 220/844; 220/909

[58] Field of Search ..... 220/524, 525, 220/526, 212.5, 817, 819, 826, 833, 843, 844, 909

[56] References Cited

U.S. PATENT DOCUMENTS

| | | | |
|---|---|---|---|
| 4,143,695 | 3/1979 | Hoehn | 220/826 |
| 4,158,424 | 6/1979 | Carmack | 220/826 |
| 4,412,616 | 11/1983 | Williams | 220/819 X |
| 5,035,563 | 7/1991 | Mezey . | |
| 5,088,616 | 2/1992 | Susko et al. | 220/844 |
| 5,205,698 | 4/1993 | Mezey . | |
| 5,423,448 | 6/1995 | Pedigo | 220/826 X |

FOREIGN PATENT DOCUMENTS

| | | |
|---|---|---|
| 17769/95 | 6/1995 | Australia . |
| 40474/95 | 2/1996 | Australia . |
| 356003 | 4/1980 | Austria . |
| 2558433 | 6/1977 | Germany . |
| 90 13 881 U | 1/1991 | Germany . |
| 4200034A1 | 7/1992 | Germany . |
| 19523056A1 | 1/1996 | Germany . |
| 501538C1 | 3/1995 | Switzerland . |

*Primary Examiner*—Stephen K. Cronin
*Attorney, Agent, or Firm*—Venable; George H. Spencer; Robert Kinberg

[57] ABSTRACT

The collection of household refuse using multichamber refuse containers poses problems if automatic container grippers are used since the section lids of the container can no longer be opened manually before the container is tipped into the vehicle. In particular in the case of multichamber refuse containers having a partition which is attached perpendicularly to the axis of rotation of the container lid in the container, there is the risk that as the refuse is being tipped into the vehicle, the section lids of the container will collide with the partition of the vehicle and therefore will not open completely. The patent specification proposes various means, such as changing the geometry of the axis of rotation of the section lids, or curved control means attached to the refuse container.

9 Claims, 3 Drawing Sheets

REFUSE CONTAINER, MULTICHAMBER REFUSE CONTAINER IN PARTICULAR

FIELD OF THE INVENTION

The invention relates to commercially available multichamber refuse containers, or refuse containers for which a partition is to be provided, said refuse containers generally being made by plastic injection molding and having an approximately quadrangular cross-sectional shape. These divided refuse containers allow cost-efficient collection of various types of refuse.

DESCRIPTION OF THE PRIOR ART

The emptying of multichamber refuse containers takes place in such a manner that the various fractions are simultaneously emptied into different filling chutes of a collection vehicle very feasibly without losing any time. This principle is shown for the first time in DE 25 58 433 and since then has been introduced successfully internationally. If the container having a partition (or partitions) is raised up by the lifting and tipping device and with its filling opening tipped downward for emptying, its partition has to be rapidly and securely brought against the partition of the filling device on the vehicle so that the refuse fractions pass safely into the particular storage spaces in the vehicle. This does not generally pose any problems in those refuse containers whose partitions remain perpendicular during emptying, as long as the refuse containers are hooked manually into the lifting and tipping device on the vehicle with the lid or the section lids being opened manually beforehand.

Problems arise if the loading of the refuse containers takes place automatically from the driver's cab because the lid or the lids likewise have to be opened automatically. The object of the invention is, in particular in the case of refuse containers having a "longitudinal division", i.e. in which the partition in the refuse container runs perpendicularly to the axis of rotation of the container lid, to find ways and means of enabling the opening to take place without manual intervention, if possible. In this case, care is to be taken that the section lids do not collide with the partition in the vehicle since this would obstruct the opening. The section lids themselves, as seen with respect to each other, thus have to open widely and when the refuse container is closed have to cover the latter in a manner such that they tightly adjoin each other or even overlap so that rain does not penetrate into the container interior, and it should be possible to simultaneously empty all of the compartments of the refuse container. The intention is for this process to be feasible, if possible without those aids which are described in AU-A-17769/95 in which the lid or lids are opened with a water jet, as this can lead to valuable substances in the refuse container being thoroughly soaked and additionally requires a water tank to be carried on the vehicle.

Following is a discussion of other related prior art:

At 356 003 shows a multichamber refuse container having "a longitudinal division" and individual lids over the chambers, with an overlid ensuring that the container is sealed against the weather. DE G 90 13 881.3 and DE 40 01 717 C2 likewise do not go into the matter of rainproofness and the wide, spread-apart opening of the section lids. In these cases, the individual compartments of the container are emptied separately in a consecutive sequence which in addition is a technical/financial disadvantage in comparison to the compartments being emptied simultaneously. The problem of the simultaneous, wide opening of section lids is likewise not addressed. DE G 90 10 025.5 shows a section lid having a rain channel. However, the manner in which the section lids are caused to open such that they do not collide with the vehicle partition or tipping partition remains open. SE 501 538 merely gives one reference to fastening the partition. DE 42 00 034 A1 shows two coupled refuse containers which do actually keep a useful distance apart in the lid region, but this arrangement is expensive and difficult to maneuver in comparison to a single container having a partition. Also DE 35 31 554 A1 having a lid which can be displaced along its extent does not address the problem and moreover is relatively expensive in production. AU-A-40474/95 shows a slotted lid having a segment which can be pivoted out of the container partition and ensures a tight connection of the container/vehicle side partitions. In this case too, the matter of weatherproofness is unsolved. U.S. Pat. No. 5,035,563 and U.S. Pat. No. 5,205,698 show individual variants of DE 25 58 433 and show a lid fastening on the partition of the refuse container; however, as the refuse is being tipped out into the vehicle said lid fastening is also subjected to tensile stress, which should be avoided. It is also known to thicken the partition at its upper end and to provide it with a type of rain channel which is intended to ensure that the rain flows off longitudinally, for example, to the container front and/or rearside. This presupposes an upright positioning of the container at ground level, which rarely happens, and also reduces the size of the filling and emptying opening of the container.

SUMMARY OF THE INVENTION

The above described problems are solved in accordance with the invention by the provision of a refuse container which has at least one chamber having a side wall and an opening, at least two partial lids which cover the chamber opening, and means connecting the lids to a side wall of the container so that the partial lids may be opened and closed by rotation about respective rotational axes both located on the same side of the chamber opening, the connecting means causing the rotational axes to form an angle during an opening of the least one of the partial lids in order to execute a spreading movement of the at least two partial lids and/or at least one of the partial lids to execute a lateral movement during the opening which is directed toward an outside of the container.

As a result of the invention, it is possible for the first time to arrange the section lids of a refuse container such that they overlap, in fact in a completely weatherproof manner, and nevertheless in the emptying position, i.e. when the container is rotated so that the container opening points downward, the section lids open out far apart so that the container lids do not collide with the partition in the vehicle and there is virtually no reduction in size of the area of the container opening. The various designs and combinations make possible a solution which is matched to the particular circumstances.

BRIEF DESCRIPTION OF THE DRAWINGS

The present invention will be more fully understood and appreciated from the following detailed description of the preferred embodiments considered in conjunction with the drawings in which.

DETAILED DESCRIPTION OF THE INVENTION

Figure 1:
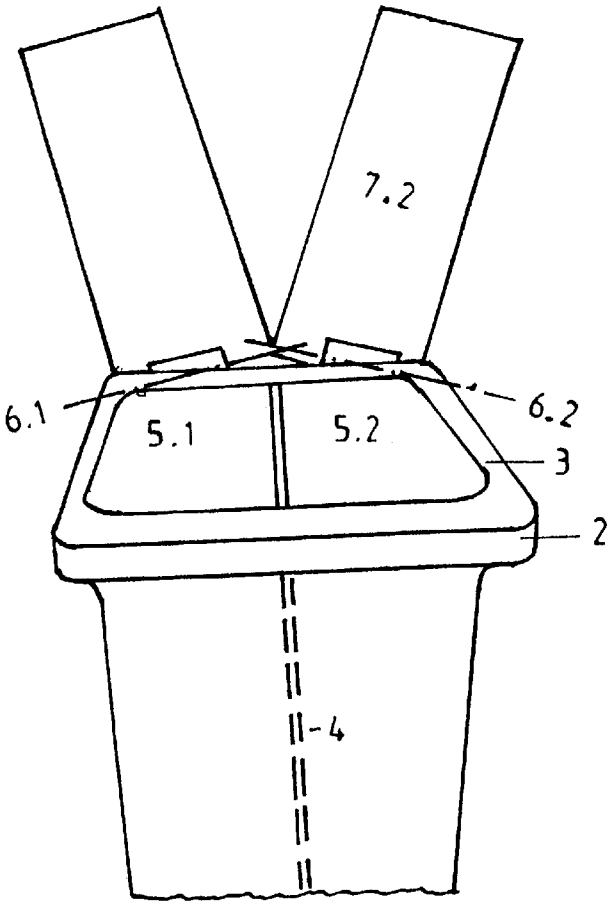
FIG. 1 is a schematic partial perspective view of a refuse container, according to one embodiment of the invention, showing two chambers and two lids.

FIG. 1 shows a first design of the invention: The refuse container 1 has a collar strip 2 for the incorporation of the refuse container into a known tipping device during emptying ("collar tipping"), and a peripheral, upper container edge 3. The container 1 has a partition 4 which runs from the front to the rear in the container and divides the container into the chambers 5.1 and 5.2 which serve in a known manner to accommodate various types of refuse. The container lid 7 can be opened and closed about an axis of rotation 6. The lid is fastened to the container in a novel manner so that the section lids 7.1 and 7.2 open out with a spreading-apart movement during opening. This happens both when opening manually to fill the container chambers 5.1 and 5.2 and also as the container is being pivoted into the vehicle. This movement apart of the container lids 7.1 and 7.2 is brought about by the lid axes 6.1 and 6.2 which run obliquely with respect to the horizontal and with respect to one another. In this case, the customary transportation handle of the container can also be retained horizontally if the straight line through the external bearing of the lid forms an oblique axis.

Figure 2:
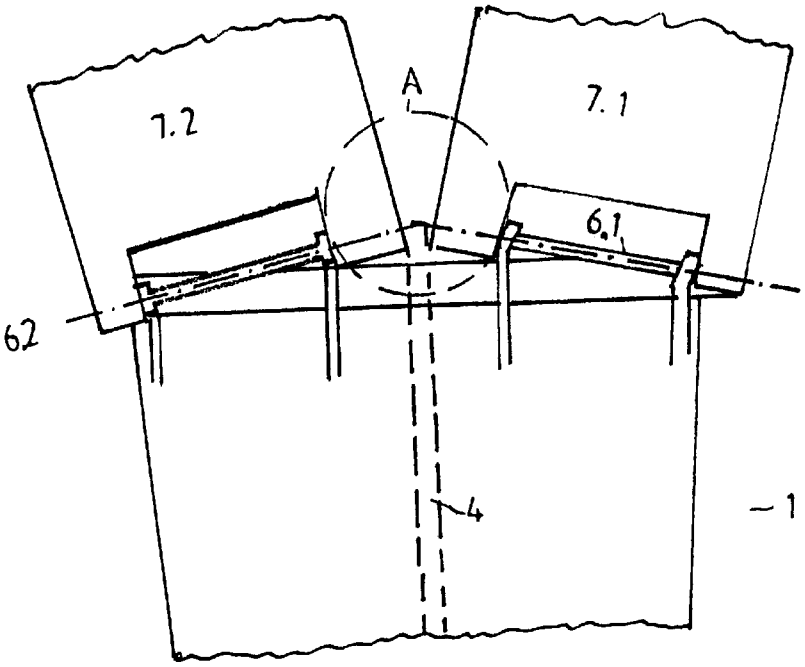
FIG. 2 is a partial elevational rear view of the refuse container shown in FIG. 1.

FIG. 2 shows a rear view of the upper part of a novel refuse container and clarifies the position and fixing of the axes of rotation 6.1 and 6.2 on the refuse container, the transportation handle being positioned obliquely as the axis of rotation of the cover.

Figure 3:
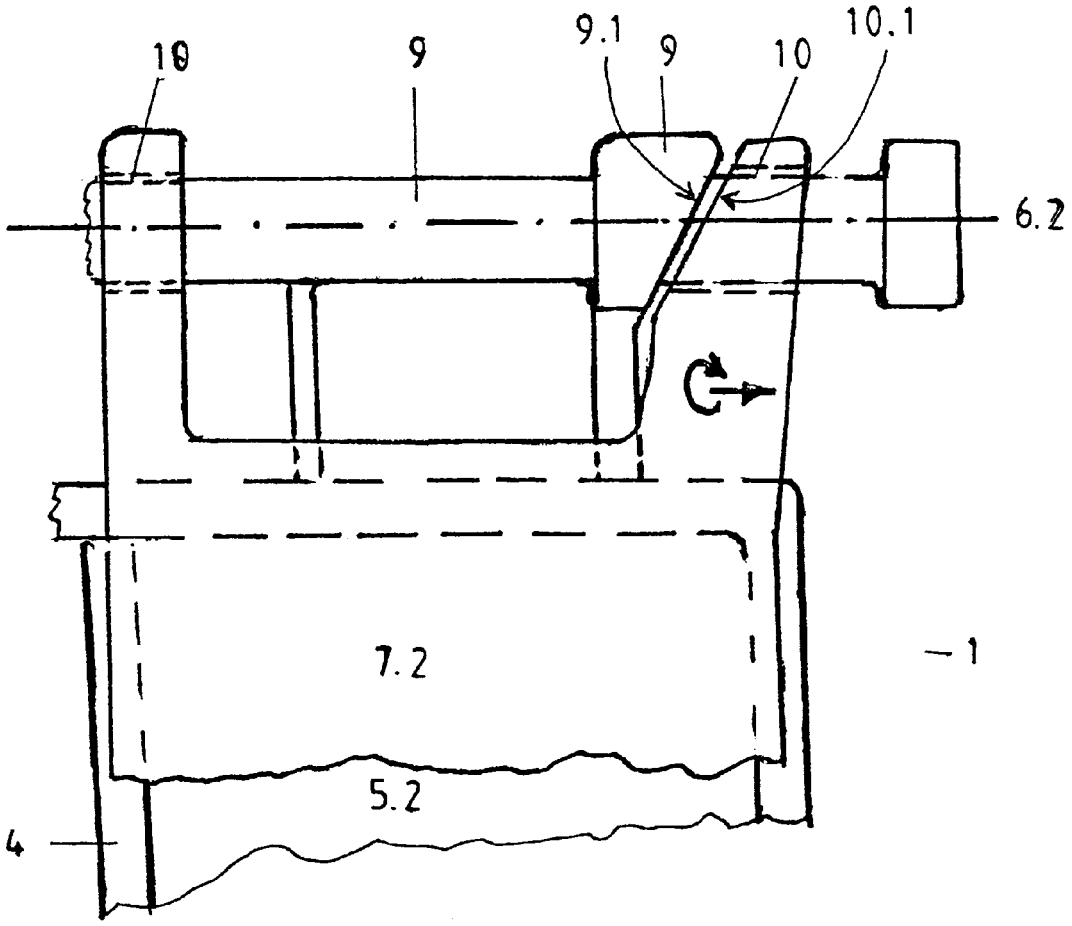
FIG. 3 is a plan view of a modified embodiment of the invention showing the connecting rotating means and lateral movement means.

FIG. 3 shows a plan view of a further design with a lid mounting on the container, which mounting ensures a wide, spreading-apart opening of the section lids. In this case, an oblique or helicoidal bearing surface between the lid fastening and mounting on the container is used. During opening the section lid 7.2 is raised about its axis of rotation 6.2 by means of the container handle 9 over the inclinations 9.1 and 10.1, as shown by the arrows, and is moved apart from the container partition 4. This can likewise be carried out on the other container side, but in this case in a laterally reversed manner.

Of course, a combination of the designs of FIGS. 1 and 3 results in the section lids 7.1 and 7.2 optimally moving apart during the opening because in this case the section lids are also moved apart in region A (FIG. 2). The section lids can in this manner safely and easily be moved past a partition positioned in the filling region of the vehicle and nevertheless tightly adjoin one another in their inoperative position.

Figure 5:
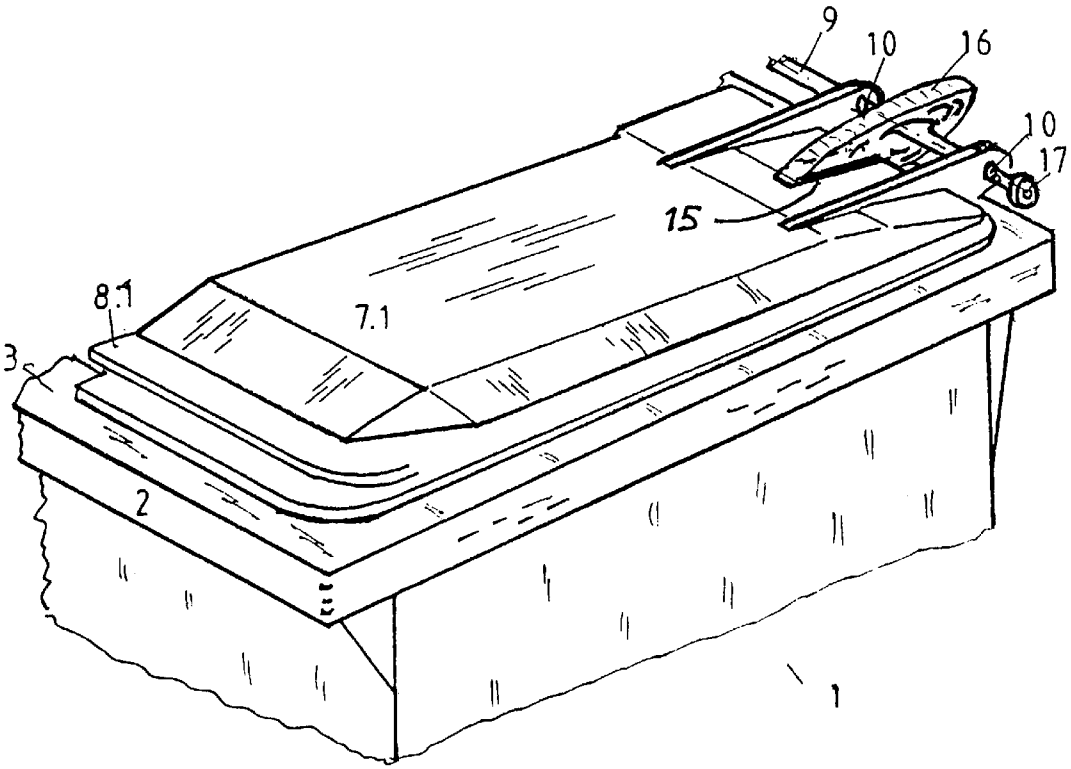
FIG. 5 is a partial perspective view of a further embodiment of the invention showing a refuse container with a curved control device.

FIG. 5 shows a further novel design of how the section lids can be moved apart during the opening. A curved control in the region of the axis (axes) of rotation of the lid enables the section lids to move apart transversely with respect to the opening movement, the movement in the direction of the axis of rotation being brought about by the interaction of a groove 15 on the rear lid end and a web 16, which is fitted obliquely with respect to the perpendicular of the refuse container, on the upper side of the refuse container. Of course, the groove can also be fitted on the container and the web on the lid.

It is also possible for one of the container lids 7.1 to be provided with elastic or, in particular, interlocking means so that it remains securely closed until emptying of the container in the upside-down position and can be opened in a positively controlled manner, for example by means of a trigger, if it has reached its final position. In this manner, provision is made for the refuse to be separated cleanly and against it being tipped onto the road even when the container is being pivoted into the vehicle opening.

Figure 4:
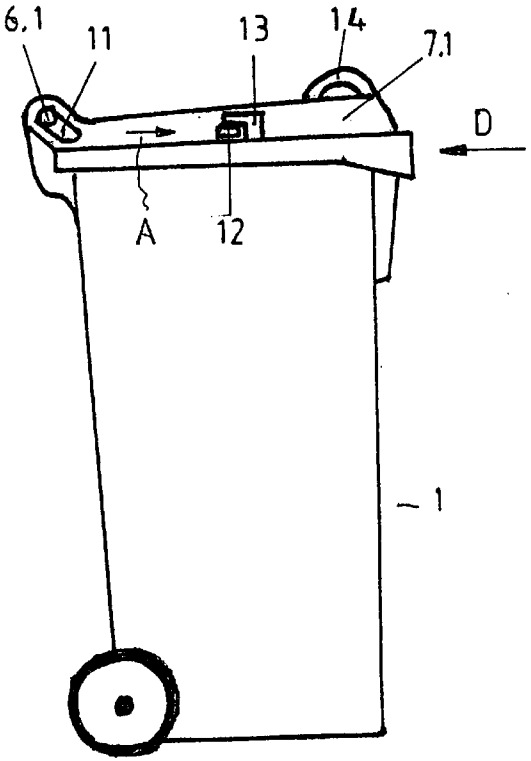
FIG. 4 is a side elevational view of another embodiment of the invention showing a refuse container with a handle on the lid and means for securing the lid to a side wall.

FIG. 4 shows a very simple design of a closure of this type. The elongated hole 11, which preferably runs obliquely forward/downward, on the lid bearing 10 makes possible a relative movement as the lid is being closed (arrow A) and, via the peg 12 and stop 13, closure of the lid during a rotating and tipping movement as the container is being emptied. If, for example, the lid 7.1, encounters an obstacle at the end of the process of being pivoted into the opening of the refuse vehicle, it undergoes a movement to the rear (arrow D), thereby unhooks the closure provided by the peg 12 and stop 13 and pivots open. Instead of the pin which is shown it is also possible to use, for example, the lid front edge which retracts under a corresponding mounting.

Of course, a closure of this type may also be of interest for an undivided refuse container having a single lid, in order to avoid pollution during the collection of refuse.

A closure of this type imparts additional support to a partition until the lid is unlocked during the emptying process if at least one lid is designed such that it rests on the partition 4. By this means, the customarily used clip fastenings for the partition are relieved of load and the partition held better.

Since multichamber refuse containers are advantageously produced in such a manner that the partition can at any time subsequently easily be fitted (see EP 0 428 185 B1), it is useful also to provide the invention for those refuse containers which still do not have a partition, so that the lid does not have to be retrofitted if a refuse container is provided with a partition and is to be used as a multichamber refuse container. This only insignificantly increases the costs of producing a refuse container.

Of course, the invention can also be used for those refuse containers which have more than two compartments due to a longitudinal or transverse division.

Furthermore, the tight closure described can also be used for the safe emptying of refuse containers whose partition runs parallel to the axis of rotation of the lid.

What is claimed is:

1. Refuse container, comprising: means defining at least one chamber having at least one side wall and at least one opening;

a least two partial lids for covering and uncovering the at least one opening; and means for connecting the partial lids to the at least one side wall, respective rotational axes both located on one side of the chamber opening, the connecting means for causing at least one of: (1) the rotational axes to form an angle during an opening of at least one of the partial lids in order to execute a spreading movement of the at least two partial lids; and (2) at least one of the partial lids to execute a lateral movement during the opening, which is directed toward an outside of the container.

2. Refuse container according to claim 1, wherein the partial lids overlap while in a closed position, thus preventing the penetration of weather effects including rain and snow.

3. Refuse container according to claim 1, further comprising one of specially placed handles and webs for unlocking the partial lids.

4. Refuse container according to claim 1, further including a partition disposed for dividing the chamber into multiple chambers and wherein at least one of the partial lids when closed includes means for holding the partition in a form-fitting manner in its position during a process of tipping the container as it is emptied.

5. Refuse container according to claim 1, wherein the at least one chamber comprises multiple chambers.

6. Refuse container according to claim 1, further including fastening means for temporarily holding at least one of the partial lids in a closed position during an emptying of the refuse container.

7. Refuse container according to claim 6, further comprising fastening means installed on at least one partial lid for keeping the partial lids in a tightly closed position during a process of pivoting the container into a refuse vehicle opening.

8. Refuse container according to claim 6 further including a curved control device for controlling a partial lid movement during opening in a direction from a center of the container toward an opposite, outer side of the container.

9. Refuse container according to claim 8, wherein the curved control device, for a purposeful movement of the partial lid from the container center toward an opposite, outer container side is attached in a region of the rotational axis of at least one of the partial lids.

* * * * *